US010301572B1

(12) United States Patent
Heymann et al.

(10) Patent No.: US 10,301,572 B1
(45) Date of Patent: May 28, 2019

(54) PROCESS FOR EXTRACTING FATTY ACIDS FROM TRIGLYCERIDE OILS

(71) Applicant: Evonik Degussa GmbH, Essen (DE)

(72) Inventors: Jennifer Heymann, Duesseldorf (DE); Matthias Bahlmann, Heiden (DE); Jan Wolter, Duesseldorf (DE)

(73) Assignee: Evonik Degussa GmbH, Essen (DE)

( * ) Notice: Subject to any disclaimer, the term of this patent is extended or adjusted under 35 U.S.C. 154(b) by 0 days.

(21) Appl. No.: 15/946,791

(22) Filed: Apr. 6, 2018

(30) Foreign Application Priority Data

Nov. 10, 2017 (EP) ..... 17201077

(51) Int. Cl.
*C11B 7/00* (2006.01)
*C11B 3/00* (2006.01)

(52) U.S. Cl.
CPC ..... *C11B 7/0083* (2013.01); *C11B 3/006* (2013.01); *C11B 7/0025* (2013.01)

(58) Field of Classification Search
CPC ..... C11B 3/006; C11B 3/06; C11B 7/0083; C11B 7/0025
See application file for complete search history.

(56) References Cited

U.S. PATENT DOCUMENTS

| | | | | |
|---|---|---|---|---|
| 2,200,391 | A * | 5/1940 | Freeman | C11B 7/0008 106/311 |
| 2,771,480 | A | 11/1956 | Chasanov et al. | |
| 4,199,440 | A | 4/1980 | Verachtert | |
| 4,533,501 | A | 8/1985 | Sen Gupta | |
| 4,629,588 | A | 12/1986 | Welsh et al. | |
| 4,915,876 | A | 4/1990 | Lindsay | |
| 4,959,158 | A | 9/1990 | Meikrantz | |
| 5,243,059 | A | 9/1993 | Ibuki et al. | |
| 5,362,893 | A | 11/1994 | Muylle et al. | |
| 5,571,070 | A | 11/1996 | Meikrantz et al. | |
| 5,591,340 | A | 1/1997 | Meikrantz et al. | |
| 5,762,800 | A | 6/1998 | Meikrantz et al. | |
| 6,395,948 | B1 | 5/2002 | Hope et al. | |
| 6,407,271 | B1 | 6/2002 | Deffense | |
| 7,638,636 | B2 | 12/2009 | Zhou et al. | |
| 2001/0005759 | A1 | 6/2001 | Bertholet | |
| 2002/0128996 | A1 | 9/2002 | Reed | |
| 2002/0169071 | A1 | 11/2002 | Sauvage et al. | |
| 2002/0198100 | A1 | 12/2002 | Mehnert et al. | |
| 2003/0085156 | A1 | 5/2003 | Schoonover | |
| 2005/0010076 | A1 | 1/2005 | Wasserscheid et al. | |
| 2006/0070919 | A1 | 4/2006 | Vallee et al. | |
| 2007/0142685 | A1 | 6/2007 | Elomari et al. | |
| 2008/0306319 | A1 | 12/2008 | Earle et al. | |
| 2009/0326228 | A1 | 12/2009 | Vaultier et al. | |
| 2010/0187481 | A1 | 7/2010 | Bodesheim et al. | |
| 2010/0324318 | A1 | 12/2010 | Prakash et al. | |
| 2011/0027431 | A1 | 2/2011 | Fejer et al. | |
| 2011/0146135 | A1 | 6/2011 | Brandvold | |
| 2011/0207953 | A1 | 8/2011 | Corley et al. | |
| 2012/0132564 | A1 | 5/2012 | Hardacre et al. | |
| 2014/0091008 | A1 | 4/2014 | Hardacre et al. | |
| 2014/0121397 | A1 | 5/2014 | Kase et al. | |
| 2017/0022447 | A1* | 1/2017 | Atkins | C11B 3/02 |
| 2018/0134987 | A1 | 5/2018 | Fedor et al. | |
| 2018/0134988 | A1 | 5/2018 | Fedor et al. | |
| 2018/0148665 | A1 | 5/2018 | Goodrch et al. | |

FOREIGN PATENT DOCUMENTS

| | | |
|---|---|---|
| CN | 102 031 202 | 4/2011 |
| CN | 104419519 | 3/2015 |
| CN | 106 281 672 | 1/2017 |
| DE | 196 38 459 A1 | 9/1996 |
| DE | 10 2013 010 035 A1 | 12/2014 |
| EP | 0 791 643 A1 | 8/1997 |
| EP | 1 911 829 A1 | 4/2008 |
| EP | 2 502 500 A1 | 9/2012 |
| FR | 2 861 084 A1 | 10/2003 |
| GB | 499678 | 9/1937 |

(Continued)

OTHER PUBLICATIONS

C.E.C. Rodrigues et al., Deacidification of Vegetable Oils by Solvent Extraction, Recent Patents on Engineering 2007, 1, 95-102.
Extended European Search Report dated Jan. 3, 2018 in European Application No. 17201077.9 with Translation, 17 pp.
Frédéric Destaillats, et al., "Glycidyl esters in refined palm (*Elaeis guineensis*) oil and related fractions", Part I: Formation mechanism, Food Chemistry 131 (2012) 1391-1398.
Hua Zhao, et al., "Use of ionic liquids as 'green' solvents for extractions", J Chem Technol Biotechnol 80:1089-1096 (2005), DOI: 10.1002/jctb.1333.
Rüdiger Weißhaar, "Determination of total 3-chloropropane-1 ,2-diol (3-MCPD) in edible oils by cleavage of MCPD esters with sodium methoxide", Eur. J. Lipid Sci. Technol. 2008, 110, 183-186.
Aleksandra Szydfowska-Czerniak, et al., "Spectroscopic Determination of Metals in Palm Oils from Different Stages of the Technological Process", dx.doi.org/10.1021/jf305094s | J. Agric. Food Chem. 2013, 61, 2276-2283.

(Continued)

*Primary Examiner* — Yate' K Cutliff
(74) *Attorney, Agent, or Firm* — Grüneberg and Myers PLLC

(57) ABSTRACT

A process which can extract a fatty acid from a triglyceride oil includes (a) contacting a triglyceride oil $T_1$ made of a fatty acid with an aqueous solution $W_1$ made of a quaternary ammonium salt and an aliphatic diol having 1 to 8 carbon atoms, where a triglyceride oil phase $T_2$ and an aqueous phase $W_2$ are obtained, where $T_2$ has a reduced content of fatty acids compared to $T_1$ and $W_2$ has an increased content of fatty acids compared to $W_1$; and (b) separating the triglyceride oil phase $T_2$ from the aqueous phase $W_2$. The quaternary ammonium salt includes a quaternary ammonium cation and a basic anion selected among hydroxide, alkoxide, alkyl carbonate, hydrogen carbonate, carbonate, serinate, prolinate, histidinate, threoninate, valinate, aspartate, taurinate, and lysinate.

19 Claims, No Drawings

(56) References Cited

FOREIGN PATENT DOCUMENTS

| | | | | | |
|---|---|---|---|---|---|
| GB | 708831 | | | 7/1951 | |
| GB | 764833 | | | 5/1954 | |
| GB | 912623 | | | 7/1959 | |
| GB | 1 520 523 | | | 8/1975 | |
| GB | 1520523 | | * | 8/1975 | ..... C11B 3/06 |
| GB | 2 068 404 | A | | 8/1981 | |
| JP | 08-302382 | A | | 11/1996 | |
| JP | 2000-202299 | A | | 7/2000 | |
| JP | 2006-160969 | | | 6/2006 | |
| JP | 2013-250186 | A | | 12/2013 | |
| WO | 1994/021765 | | | 9/1994 | |
| WO | 1999/012650 | | | 3/1999 | |
| WO | 2000/029120 | | | 5/2000 | |
| WO | 2000/46322 | | | 8/2000 | |
| WO | 2000/68236 | | | 11/2000 | |
| WO | 2003/075671 | A1 | | 9/2003 | |
| WO | 2006/072775 | A2 | | 7/2006 | |
| WO | 2007/101397 | A1 | | 9/2007 | |
| WO | 2007/138307 | A2 | | 12/2007 | |
| WO | 2010/063450 | A1 | | 6/2010 | |
| WO | 2010/136783 | A1 | | 12/2010 | |
| WO | 2011/005081 | A1 | | 1/2011 | |
| WO | 2011/009841 | A1 | | 1/2011 | |
| WO | 2011/009843 | A1 | | 1/2011 | |
| WO | 2011/069028 | A1 | | 6/2011 | |
| WO | 2012/004810 | A1 | | 1/2012 | |
| WO | 2012/031176 | | | 3/2012 | |
| WO | 2012/035020 | A1 | | 3/2012 | |
| WO | 2012/069632 | A1 | | 5/2012 | |
| WO | 2012/069832 | A2 | | 5/2012 | |
| WO | 2012/130747 | A1 | | 10/2012 | |
| WO | 2012/169718 | A1 | | 12/2012 | |
| WO | 2013/093093 | A1 | | 6/2013 | |
| WO | 2014/012548 | A1 | | 1/2014 | |
| WO | 2014/042937 | A1 | | 3/2014 | |
| WO | 2015/000637 | A1 | | 1/2015 | |
| WO | 2015/031857 | A2 | | 3/2015 | |
| WO | 2015/079262 | A1 | | 6/2015 | |
| WO | 2015/185657 | A1 | | 12/2015 | |
| WO | 2016/005769 | A1 | | 1/2016 | |
| WO | 2016/149692 | | | 9/2016 | |
| WO | 2016/189114 | | | 12/2016 | |
| WO | 2016/189115 | | | 12/2016 | |
| WO | 2016/189328 | | | 12/2016 | |
| WO | 2016/189330 | A1 | | 12/2016 | |
| WO | 2016/189332 | | | 12/2016 | |
| WO | 2016/189333 | A1 | | 12/2016 | |

OTHER PUBLICATIONS

Ulf Strijowski, et al., "Removal of 3-MCPD esters and related substances after refining by adsorbent material", German Institute of Food Technologies, Quakenbrueck, Germany, Eur. J. Lipid Sci. Technol. 2011, 113, 387-392.

Marcin Smiglak, et al., "New hydrogen carbonate precursors for efficient and byproduct-free syntheses of ionic liquids based on 1,2,3-trimethylimidazolium and N,N-dimethylpyrrolidinium cores", Green Chem., 2010, 12, 491-501.

Susanne Andres, et al., "Toxicology, occurrence and risk characterisation of the chloropropanols in food: 2-Monochloro-1,3-propanediol, 1,3-dichloro-2-propanol and 2,3-dichloro-l-propanol", Food and Chemical Toxicology 58 (2013) 467-478.

Frank Pudel, et al., "On the necessity of edible oil refining and possible sources of 3-MCPD and glycidyl esters", Sources of 3-MCPD and glycidyl esters during edible oil refining, Eur. J. Lipid Sci. Technol. 2011, 113, 368-373.

Peter Nockemann, et al., "Task-Specific Ionic Liquid for Solubilizing Metal Oxides", J. Phys. Chem. B 2006, 110, 20978-20992.

K. Nagy, et al., "Mass-defect filtering of isotope signatures to reveal the source of chlorinated palm oil contaminants", Food Additives & Contaminants: Part A, Chemistry, Analysis, Control, Exposure & Risk Assessment, ISSN: 1944-0049 (Print) 1944-0057 (Online) Journal homepage: http://www.tandfonline.com/loi/tfac20.

Noor Akhmazillah bt Mohd Fauzi, et al., "Trace metals content (contaminants) as initial indicator in the quality of heat treated palm oil whole extract", International Journal of Energy and Environment, vol. 2, Issue 4, 2011 pp. 671-676.

Bertrand Matthaus, et al., "Strategies for the reduction of 3-MCPD esters and related compounds in vegetable oils", Eur. J. Lipid Sci. Technol. 2011, 113, 380-386.

Bertrand Matthaus, "Organic or not organic—that is the question: How the knowledge about the origin of chlorinated compounds can help to reduce formation of 3-MCPD esters", DOI: 10.1002/ejlt.201200374, Eur. J. Lipid Sci. Technol. 2012, 114, 1333-1334.

Marina S. Manic, et al., "Extraction of Free Fatty Acids from Soybean Oil Using Ionic Liquids or Poly(ethyleneglycol)s", DOI 10.1002/aic.12349, Published online Aug. 3, 2010 in Wiley Online Library (wileyonlinelibrary.com), May 2011 vol. 57, No. 5, 1344-1355.

Ermitas Alcalde, et al., "A Simple Halide-to-Anion Exchange Method for Heteroaromatic Salts and Ionic Liquids", Molecules 2012, 17, 4007-4027; doi:10.3390/molecules17044007.

Ahmed Samy M. Abd El-Salam, et al., "Deacidification of High-acid Olive Oil", J Food Process Technol 2011, S5, pp. 1-7.

Ishiguro, S., et al., "Structure, solvation, and acid-base", Pure and applied chemistry, ISSN: 0033-4545, doi:10.1351/PAC-CON-09-10-28, vol. 82, Issue 10, Aug. 6, 2010, pp. 1927-1942.

Troy D. Haines, et al., "Direct Determination of MCPD Fatty Acid Esters and Glycidyl Fatty Acid Esters in Vegetable Oils by LC-TOFMS", J Am Oil Chem Soc (2011) DOI 10.1007/s11746-010-1732-5, 88:1-14.

European Search Report issued in EP 17201077.9 dated Mar. 1, 2018, with English translation.

Destaillats, Frederic, et al., "Formation mechanisms of Monochloropropanediol (MCPD) fatty acid diesters in refined palm (*Elaeis guineensis*) oil and related fractions," Food Additives & Contaminants: Part A, ISSN: 1944-0049 (Print) 1944-0057 (Online) Journal homepage: http://www.tandfonline.com/loi/tfac20, vol. 29, No. 1, Jan. 2012, 29-37.

A.J. Dijkstra, et al., "Determination of Trace Elements in Oils by Plasma Emission Spectroscopy", The journal of the American Oil Chemists' Society, Apr. 1982, vol. 59, pp. 199-204.

Amanda C. Cole, et al., "Novel Brønsted Acidic Ionic Liquids and Their Use as Dual Solvent-Catalysts", J. Am. Chem. Soc. 2002, 124, 5962-5963.

Abello, S., et al., "Supported choline hydroxide (ionic liquid) as heterogeneous catalyst for aldol condensation reactions", Royal Society of Chemistry, 2004, Issue 9, pp. 1096-1097.

Rodrigues et al., "Deacidification of Vegetable Oils by Solvent Extraction," Recent Patents on Engineering, 2007, 1, 95-102.

U.S. Appl. No. 15/576,697, filed Nov. 22, 2017, 2018/0134987, Fedor et al.

U.S. Appl. No. 15/576,700, filed Nov. 22, 2017, 2018/0134988, Fedor et al.

* cited by examiner

PROCESS FOR EXTRACTING FATTY ACIDS FROM TRIGLYCERIDE OILS

This application claims priority to European Patent Application No. 17201077.9, filed on Nov. 10, 2017.

The invention relates to an improved process for extracting fatty acids from triglyceride oils. The extraction of the triglyceride oil is carried out in this case with an aqueous solution comprising at least one quaternary ammonium salt and at least one aliphatic diol comprising 1 to 8 carbon atoms. The process according to the invention is characterized by high efficiency.

BACKGROUND OF THE INVENTION

Natural fats and oils have various undesirable components such as metals, free fatty acids and phospholipids and therefore have to be refined. In the refining of natural fats and oils, a distinction is made between physical and chemical refining.

In the case of chemical refining, which is used predominantly for triglyceride oils having a low fraction of free fatty acids, the free fatty acids are separated off by reaction with a base. So-called soapstocks are formed in this case, an aqueous mixture of base, free fatty acids, the salts of the free fatty acids and also oil. These soapstocks are an undesired by-product of chemical refining which are of low value and limited use.

In the case of physical refining, which is used predominantly for triglyceride oils having a relatively high fraction of free fatty acids, the free fatty acids are in contrast separated off thermally. In this way, the formation of soapstocks may be avoided, but at the same time high temperatures (up to 260° C.) have to be applied in order to be able to separate off the free fatty acids from the oil by distillation.

In addition to chemical and physical refining, other methods are described in the prior art by which free fatty acids may be separated off or soapstocks may be processed. For example, liquid-liquid extraction techniques are used here (C. E. C. Rodrigues, C. B. Gonçalves, E. Batista, J. A. Meirelles, Recent Patents on Engineering 2007, 1, 95-102).

WO 2016/149692 A1 describes the acidification of aqueous solutions which originate from saponification reactions and comprise lipids. The lipid-containing raw material is mixed with base (especially sodium or potassium hydroxide) and saponified. $CO_2$ is then injected, reacted with the reaction mixture and the aqueous phase is removed.

In addition, U.S. Pat. No. 2,771,480 also describes the regeneration of fatty acids by means of ion exchangers. This, however, is very costly.

CN 106281672 A describes the treatment of triglyceride oils with antioxidants (e.g. tocopherol, lactate) and alkali metal salts thereof for removing trichloropropanol and derivatives thereof.

WO 2012/031176 A1, WO 2016/189114 A1, WO 2016/189115 A1 and WO 2016/189328 A1 describe the treatment of triglyceride oils with quaternary ammonium salts and solutions thereof for removing free fatty acids, metals and other undesirable components.

In WO 2016/189114 A1, a triglyceride oil is extracted with an aqueous solution of a basic quaternary ammonium salt in order to remove fatty acids therefrom. After extraction, the phases are separated. To regenerate the aqueous solution, which is necessary in order to be able to use this in a new extraction step of the process, this aqueous phase, charged with fatty acid salts from the triglyceride oil, is pressurized with $CO_2$. Free fatty acids are formed from the fatty acid salts as a result, which may be separated off from the aqueous phase.

Although WO 2016/189114 A1 discloses a reliable method for extracting free fatty acids from triglyceride oils, this method has a problem, especially in industrial scale applications. Quaternary ammonium salts are surface-active and are frequently used as cationic surfactants in soaps and fabric softeners. Their removal after treatment of triglyceride oils is therefore technically very demanding right from the start since they emulsify with water and oil and complicate the phase separation. The quaternary ammonium salts used in the extraction of the fatty acids from the triglyceride oil can therefore only be removed with difficulty, or not completely removed, from the triglyceride oil.

This is especially disadvantageous when using the extracted triglyceride oils as edible oils: not only are some quaternary ammonium salts of concern to health, quaternary ammonium salts, and especially choline, also have the tendency to a foul smell and sometimes even dark-colored deposits. This causes a distinct reduction in quality of the extracted oil. It is therefore desirable to further improve the extraction technique of the prior art (e.g. WO 2016/189114 A1).

It is therefore an object of the present invention to provide a process for extracting fatty acids from triglyceride oils which does not have the aforementioned disadvantages.

Above all, a process should be provided which allows reuse of the phases and at the same time ensures high quality of the extracted triglyceride oil.

DETAILED DESCRIPTION OF THE INVENTION

It has now been found that, surprisingly, when extracting triglyceride oils with ammonium salts, the fraction of quaternary ammonium salt in the extracted oil can be lowered significantly if an aliphatic diol having 1 to 8 carbon atoms is added to the quaternary ammonium salt, wherein ethylene glycol and propanediols, especially ethylene glycol and 1,2-propanediol, are most suitable.

Accordingly, the invention relates to a process for extracting fatty acids from triglyceride oils comprising the following steps:

(a) contacting a triglyceride oil $T_1$ comprising fatty acids with an aqueous solution $W_1$ comprising at least one quaternary ammonium salt and at least one aliphatic diol having 1 to 8 carbon atoms, whereby a triglyceride oil phase $T_2$ and an aqueous phase $W_2$ are obtained, wherein $T_2$ has a reduced content of fatty acids compared to $T_1$ and $W_2$ has an increased content of fatty acids compared to $W_1$;

(b) separating the triglyceride oil phase $T_2$ from the aqueous phase $W_2$:

wherein the quaternary ammonium salt comprises at least one quaternary ammonium cation and at least one basic anion selected from hydroxide, alkoxide, alkyl carbonate, hydrogen carbonate, carbonate, serinate, prolinate, histidinate, threoninate, valinate, aspartate, taurinate, lysinate.

In the context of the invention, the term "quaternary ammonium cation" means a cation having at least one nitrogen atom and one positive charge, in which said nitrogen atom is only bonded to carbon atoms. The nitrogen atom may be saturated and may be bonded to 4 carbon atoms by single bonds, or it may be unsaturated and be bonded to two carbon atoms by a single bond and to a third carbon atom by a double bond.

If the nitrogen atom is unsaturated, it may also be part of a heteroaromatic ring such as, for example, an imidazolium cation or a dialkylimidazolium cation (e.g. 1-methyl-3-ethylimidazolium cation, 1,3-dimethylimidazolium cation, 1,3-diethylimidazolium cation).

If the nitrogen atom is saturated, it may also be part of an alicyclic ring, for example a pyrrolidinium ring or piperidinium ring.

Advantageously, the nitrogen atom is bonded to 4 substituted or unsubstituted hydrocarbon groups having 1 to 12 carbon atoms, wherein these hydrocarbon groups may bear further substituents, wherein these substituents are preferably on carbon atoms which are not bonded to the positively charged nitrogen atom.

In the context of the invention, hydrocarbon group preferably means alkyl, cycloalkyl, alkenyl, alkynyl or aryl.

The quaternary ammonium salt in the present invention is advantageously and preferably used as a liquid which comprises the salt. It is not volatile and exists as part of the liquid only in its ionic form.

The liquid is preferably the solution of the salt in a solvent, for example water.

Possible solvents are selected from polar solvents such as water, ethanol, methanol or mixtures thereof for example. Preference is given to using water as solvent. The quaternary ammonium salt may be an ionic liquid.

The expression ionic liquid is known to those skilled in the art and is described, for example, in U.S. Pat. No. 7,638,636 B2.

The quaternary ammonium cation is preferably selected from a compound according to the structure $$[N(R^a)(R^b)(R^c)(R^d)]^+,$$

where $R^a$, $R^b$, $R^c$ and $R^d$ are each independently selected from $C_1$ to $C_8$ alkyl, wherein one or more of the radicals $R^a$, $R^b$, $R^c$ and $R^d$ may optionally be substituted on one carbon atom, which is preferably not bonded directly to the positively charged nitrogen, by a group selected from: $C_1$ to $C_4$ alkoxy, $C_2$ to $C_8$ alkoxyalkoxy, $C_3$ to $C_6$ cycloalkyl, —OH, —SH, —$CO_2R^e$, and —OC(O)$R^e$, where $R^e$=$C_1$ to $C_6$ alkyl. For example, it may be substituted by one to three OH groups.

The quaternary ammonium cation is more preferably selected from a compound according to the structure $$[N(R^a)(R^b)(R^c)(R^d)]^+,$$

where $R^a$, $R^b$, $R^c$ and $R^d$ are each independently selected from $C_1$ to $C_4$ alkyl, including methyl, ethyl, n-propyl, isopropyl, n-butyl, se-butyl, isobutyl and tert-butyl, wherein at least one of the radicals $R^a$, $R^b$, $R^c$ or $R^d$ may be substituted on one carbon atom, which is not bonded directly to the positively charged nitrogen, by an OH group. Substituted radicals $R^a$, $R^b$, $R^c$ or $R^d$ are preferably 2-hydroxyethyl, 2-hydroxypropyl or 2 hydroxy-2-methylethyl.

The quaternary ammonium cation most preferably used is choline: $(CH_3)_3N^+CH_2CH_2OH$.

The quaternary ammonium salt comprises in addition at least one basic anion selected from hydroxide, alkoxide, alkyl carbonate, hydrogen carbonate, carbonate, serinate, prolinate, histidinate, threoninate, valinate, aspartate, taurinate, lysinate.

In one embodiment, the basic anion is selected from alkyl carbonate, hydrogen carbonate, carbonate, hydroxide, alkoxide. More preferably, it is selected from alkoxide, hydrogen carbonate, alkyl carbonate and carbonate; most preferably hydrogen carbonate.

If the basic anion is selected from alkoxide or alkyl carbonate, the alkyl group is unbranched or branched and substituted or unsubstituted. It is preferably unbranched and unsubstituted.

An alkyl group in accordance with the invention preferably comprises 1 to 10 carbon atoms, more preferably 1 to 8, most preferably 1 to 4 carbon atoms. The alkyl group may be selected from methyl, ethyl, propyl, butyl, pentyl, hexyl, heptyl, octyl, nonyl, decyl. Also usable are branched alkyl groups such as isopropyl, isobutyl, sec-butyl, tert-butyl. The alkyl group is particularly preferably selected from methyl, ethyl, propyl, butyl, more preferably selected from methyl, ethyl.

Particularly preferred in the process according to the invention is a quaternary ammonium salt which comprises a choline cation.

Very particular preference is given to using in the process according to the invention a quaternary ammonium salt which is selected from choline hydrogen carbonate: $(CH_3)_3N^+CH_2CH_2OH\ HOCOO^-$; choline hydroxide: $(CH_3)_3N^+CH_2CH_2OH\ OH^-$, choline alkyl carbonate: $(CH_3)_3N^+CH_2CH_2OH\ ROCOO^-$ where R is an alkyl group having in particular 1 to 4 carbon atoms and more preferably 2 to 3 carbon atoms. Most preference is given to using choline hydrogen carbonate: $(CH_3)_3N^+CH_2CH_2OH\ HOCOO^-$.

The solution $W_1$ used in step (a) of the process according to the invention also comprises at least one aliphatic diol having 1 to 8, in particular 1 to 6, preferably 1 to 5, more preferably 1 to 4, even more preferably 1 to 3 carbon atoms, wherein said diol is particularly preferably selected from the group consisting of ethylene glycol (=1,2-ethanediol), propanediols, and more preferably from ethylene glycol and 1,2-propanediol.

In accordance with the invention, "propanediol" means any propane bearing 2 OH groups, no matter on which of the carbon atoms, preferably 1,2-propanediol or 1,3-propanediol.

An aliphatic diol having 6 carbon atoms is preferably 1,6-hexanediol.

By way of preference, in the aqueous solution $W_1$ in step (a) of the process according to the invention, the proportion of aliphatic diol relative to quaternary ammonium salt is such that the molar amount of all aliphatic diols having 1 to 8 carbon atoms, based on the molar amount of all quaternary ammonium salts, wherein the quaternary ammonium salt comprises at least one quaternary ammonium cation and at least one basic anion selected from hydroxide, alkoxide, alkyl carbonate, hydrogen carbonate, carbonate, serinate, prolinate, histidinate, threoninate, valinate, aspartate, taurinate and lysinate, is in the range from 0.0001% to 99.9%, preferably 0.01% to 50.0%, more preferably 0.1% to 40.0%, even more preferably 1.0% to 30.0%, most preferably 10.0% to 20.0%, especially preferably 15.3% to 18.8% and at best 17.6%.

In a preferred embodiment, the process according to the invention includes step (c):

(c) adding $CO_2$ and optionally an organic solvent to the aqueous phase $W_2$, whereby an aqueous phase $W_3$ having a lower content of fatty acids compared to $W_2$, and a fatty acid-containing organic phase, are obtained.

In an even more preferred embodiment, a further step (d) follows on:

(d) separating off the aqueous phase $W_3$ from the fatty acid-containing organic phase obtained in step (c).

It has now been found that, surprisingly, the problems arising in the prior art, i.e. the elevated content of quaternary ammonium salt in the triglyceride oil freed from fatty acids, by adding an aliphatic diol having 1 to 8 carbon atoms instead of the ionic liquid alone, as described in the prior art (in particular the choline salt from WO 2016/189114 A1), leads to improved quality of the extracted triglyceride oil.

The feature "triglyceride oil" in accordance with the invention comprises any oil or fat of which the main constituent are triglycerides to an extent of >50% by weight. Besides the main constituent of triglycerides, the oil or fat may also comprise mono- and diglycerides.

The triglyceride oil is preferably of natural origin and more preferably of animal or vegetable origin. The triglyceride oil is more preferably a fat or oil of vegetable origin.

Contemplated as fats and oils of vegetable origin and comprising aroma chemicals are in particular (latin names which may be indicated in brackets refer to the plant species from which the relevant oil may be derived): algae oil, apricot kernel oil (*Prunus armeniaca*), argan oil (*Argania spinosa*), avocado oil (*Persea americana*), babassu oil (*Attalea speciosa*), cottonseed oil (*Gossypium*), ben oil (*Moringa oleifera*), borage oil (*Borago officinalis*), nettle seed oil (*Urtica pilulifera* or *Urtica dioica*), beech oil (*Fagus*), cashew shell oil (*Anacardium occidentale*), oil from plants of the genus *Citrus* (for example lemons, oranges, grapefruit, limes), cupuaçu butter (*Theobroma grandiflorum*), safflower oil (*Carthamus*), peanut oil (*Arachis hypogaea*), rosehip seed oil (Rosa), hemp oil (*Cannabis*), hazelnut oil (*Corylus avellana*), *jatropha* oil (*Jatropha curcas*), jojoba oil (*Simmondsia chinensis*), coffee bean oil (*Coffea*), cocoa butter (*Theobroma cacao*), tea seed oil (*Camellia*), acai palm (*Euterpe oleracea*), coconut oil (*Cocos nucifera*), pumpkin seed oil (*Cucurbita*), false flax oil (*Camelina sativa*), linseed oil (*Linum*), corn oil (*Zea mays*), *macadamia* oil (*Macadamia integrifolia, Macadamia tetraphylla*), almond oil (*Prunus dulcis*), mango butter (*Mangifera indica*), corn oil (*Zea mays*), poppyseed oil (*Papaver*), evening primrose oil (*Oenothera biennis*), olive oil (*Olea europaea*), palm oil (oil obtainable from a plant of the genus *Elaeis*), especially *Elaeis guineensis, Elaeis oleifera*), *papaya* seed oil (*Carica papaya*), pecan nut oil (*Carya illinoinensis*), *perilla* oil (*Perilla frutescens*), pine nut oil (plants from the genus *Pinus*), pistachio oil (*Pistacia vera*), rapeseed oil (*Brassica napus*), rice bran oil (*Oryza sativa*), castor oil (*Ricinus communis*), sea buckthorn kernel oil (kernels of *Hippophae rhamnoides*), sea buckthorn oil (flesh of *Hippophae rhamnoides*), black caraway oil (*Nigella sativa*), mustard oil (*Brassica nigra*), sesame oil (*Sesamum indicum*), shea butter (*Vitellaria paradoxa*), soybean oil (*Glycine max*), sunflower oil (*Helianthus annuus*), grapeseed oil (*Vitis vinifera*), tung oil (*Vernicia, Aleurites*), walnut oil (*Juglans regia*), watermelon seed oil (*Citrullus lanatus*), wheat germ oil (*Triticum*). The fats and oils of vegetable origin are preferably selected from coconut oil, corn oil, cottonseed oil, olive oil, palm oil, peanut oil, rice bran oil, soybean oil, sunflower oil, rapeseed oil, castor oil, safflower oil. The fat and oil of vegetable origin is most preferably palm oil.

Contemplated as fats and oils of animal origin and comprising aroma chemicals are in particular. Marmot fat, butter fat, fish oil, oil obtainable from crustaceans (for example krill), cod liver oil, milk fat, pork lard, duck lard, goose lard, beef tallow, wool wax.

In the context of the invention, "fatty acids" include saturated and mono- or polyunsaturated fatty acids. In accordance with the invention, this term also includes (unless referred to otherwise in a specific case) both the protonated and the deprotonated form of the relevant fatty acid.

Examples of unsaturated fatty acids are myristoleic acid, palmitoleic acid, sapienic acid, oleic acid, elaidic acid, vaccenic acid, linoleic acid, linolelaidic acid, α-linolenic acid, arachidonic acid, eicosapentaenoic acid, erucic acid and docosahexaenoic acid. Examples of saturated fatty acids are caprylic acid, capric acid, undecanoic acid, lauric acid, tridecanoic acid, myristic acid, palmitic acid, margaric acid, stearic acid, nonadecanoic acid, arachidic acid, heneicosanoic acid, behenic acid, lignoceric and cerotic acid.

"Palm oil" signifies an oil obtainable from a plant of the genus *Elaeis* (part of the family of the palm-like or palms Arecaceae or Palmae), especially *Elaeis guineensis, Elaeis oleifera* or hybrids thereof. The palm oil may be obtained for example from the fruit or the seed of the plants.

The triglyceride oil, in particular the palm oil used in step (a), may be unrefined or at least partially refined. This also includes fractionated triglyceride oil, for example fractionated palm oil, especially stearic acid fractions or oleic acid fractions of the palm oil.

"Unrefined" triglyceride oil signifies triglyceride oil according to the invention which has not been subjected to any refining step. For example, unrefined triglyceride oil has not been passed through any of the following refining steps: degumming, deacidification, bleaching, depigmentation, deodorizing, winterization.

"Refined" triglyceride oil has been passed through at least one refining step, for example at least one selected from degumming, deacidification, bleaching, depigmentation, deodorizing, winterization.

In step (a) of the process according to the invention, a triglyceride oil $T_1$ comprising fatty acids is contacted with an aqueous solution $W_1$ comprising at least one quaternary ammonium salt and at least one aliphatic diol having 1 to 8 carbon atoms.

The temperature in step (a) of the process according to the invention is not further restricted. In particular, step (a) of the process according to the invention is conducted at a temperature <100° C., preferably at a temperature of 25° C. to 90° C., more preferably at 40° C. to 90° C. yet more preferably at 70° C. to 90° C., most preferably at 80° C.

The pressure in step (a) of the process according to the invention is likewise not further restricted. In particular, step (a) of the process according to the invention is conducted at a pressure of 1 bar to 100 bar, especially at standard pressure of 1 bar.

The triglyceride oil $T_1$ comprising fatty acids can be contacted with an aqueous solution $W_1$ comprising at least one quaternary ammonium salt and at least one aliphatic diol having 1 to 8 carbon atoms by methods known to those skilled in the art. The contacting may also take place in a vessel in which $T_1$ and $W_1$ are mixed with each other. It will be apparent that the contacting is to be carried out such that as many fatty acids as possible migrate from the triglyceride oil $T_1$ into the aqueous phase $W_1$. For this purpose, for example, a mechanical mixer (such as, for example, a stirred tank which may be operated in batchwise mode or continuously), an ultrasonic mixer or an electromagnetic mixer is used. During the contacting, an inert gas can be bubbled through the resulting mixture. Alternatively, $T_1$ and $W_1$ may also be mixed in a static mixer such as a Sulzer mixer or Kenics mixer.

It is also possible to mix $T_1$ and $W_1$ continuously in countercurrent flow, for example in a column, or in cocurrent flow. The column may be a sieve tray column, a structured packing column or an agitated column such as, for example, a Kühni column or a Scheibel column.

In the continuous processes in cocurrent flow, for example, $T_1$ and $W_1$, prior to contacting thereof, may each also be passed through a tube with the aid of a pump, at the end of which they meet and mix together, in order then to be passed through a flow tube R.

In the continuous processes in countercurrent flow in a column, for example, the trigylceride oil $T_1$ is introduced at or at least close to the bottom end of the column and the aqueous solution W is introduced at or at least close to the top end of the column.

The aqueous phase $W_2$, which has an increased content of fatty acids compared to $W_1$, is then discharged at or close to the bottom end of the column, and a triglyceride oil phase $T_2$, which has a reduced content of fatty acids compared to $T_1$, is then discharged at or close to the top end of the column.

The column preferably also has a bottom region in which a secondary stream may be collected, and more preferably the trigylceride oil $T_1$ is then fed in directly above this bottom region.

Naturally, two or more such countercurrent columns may also be used, for example 2 to 6, or 3 to 5 or 4.

It is preferable that the column also has a structured packing, for example a packing of Raschig rings or several trays.

Further possible apparatuses for mixing in cocurrent flow are mixer settlers, which can be arranged in a countercurrent cascade. Centrifugal extractors also exist, as described further below, in which steps a) and b) of the process according to the invention may be carried out in one go.

Step a) is preferably carried out in which $T_1$ and $W_1$ are mixed in cocurrent flow, more preferably in at least one mixer settler.

The ratio by volume of $T_1$ and $W_1$ in step (a) of the process is likewise not further restricted. The ratio of the volume of the triglyceride oil $T_1$ to the volume of the aqueous phase $W_1$ in this case is in particular in the range from 10:1 to 1:100, more preferably from 1:1 to 1:10, yet more preferably from 1:1.5 to 1:4, yet still more preferably 3:7.

The mixing, such as for example the contacting in the column in the case of continuous contacting, may be adjusted by a person skilled in the art such that as large a fraction as possible of the triglyceride oil phase $T_1$ migrates into the aqueous phase $W_1$. Accordingly, the contacting is carried out, for example, for 1 second to 2 hours, particularly 30 seconds to 1 hour, preferably 1 to 50 minutes, more preferably 10 to 40 minutes, most preferably 20 to 30 minutes.

In step (a) of the process according to the invention, the fatty acids contained in the triglyceride oil $T_1$ are neutralized by the quaternary ammonium salts contained in the aqueous phase $W_1$. In particular, the molar amount of all quaternary ammonium salts contained in the aqueous phase $W_1$ is at least equal to the molar amount of all fatty acids contained in the triglyceride oil $T_1$. The ratio of the molar amount of all quaternary ammonium salts contained in the aqueous phase $W_1$ to the molar amount of all fatty acids contained in the triglyceride oil $T_1$ is preferably in the range from 1:1 to 500:1, more preferably from 2:1 to 200:1, yet more preferably from 10:1 to 100:1, most preferably from 30:1 to 70:1.

The fraction of fatty acids in the triglyceride oil may be determined by methods known to those skilled in the art, for example by titration with potassium hydroxide and a phenolphthalein indicator. Following determination of the fractions of fatty acids in the triglyceride oil $T_1$, the person skilled in the art then also knows how much the desired molar amount of all quaternary ammonium salts in the aqueous phase $W_1$ must be, which can then be adjusted accordingly.

In step (a), an aqueous phase $W_1$ comprising at least one quaternary ammonium salt and at least one aliphatic diol having 1 to 8 carbon atoms is used. The aqueous solution may also comprise further solvents in addition to water, for example acetone, ethyl acetate, alcohols, preferably methanol or ethanol. The aqueous phase $W_1$, however, preferably does not contain any other solvents besides water, which signifies in accordance with the invention that the proportion by weight of the sum total of all quaternary ammonium salts and all aliphatic diols having 1 to 8 carbon atoms and of the water in $W_1$ is at least 95% by weight, preferably at least 99% by weight, more preferably at least 99.9% by weight, and the remainder thereof of $W_1$ are various chemical substances such as organic solvents.

The total concentration of all quaternary ammonium salts in the aqueous phase $W_1$ is not further restricted and is preferably in the range of 70 to 80% by weight, preferably 75% by weight, based on the total mass of the phase $W_1$.

On contacting a triglyceride oil $T_1$ comprising fatty acids with an aqueous solution comprising at least one quaternary ammonium salt and at least one aliphatic diol having 1 to 8 carbon atoms $W_1$, the fatty acids migrate from the triglyceride oil T at least partially into the aqueous phase $W_1$. Therefore, in carrying out step (a), a triglyceride oil phase $T_2$ and an aqueous phase $W_2$ are obtained, wherein $T_2$ has a reduced content of fatty acids compared to $T_1$ and $W_2$ has an increased content of fatty acids compared to $W_1$.

In step (b) of the process according to the invention, the triglyceride oil phase $T_2$ is then separated off from the aqueous phase $W_2$.

This separation may also be carried out by methods known to those skilled in the art, for example with the aid of gravity in a Settler unit. In general, the trigylceride oil phase $T_2$ is the upper phase here, whereas the aqueous phase $W_2$ is the lower phase. The separation of the triglyceride oil phase $T_2$ from the aqueous phase $W_2$ may alternatively also be carried out in a decanter, a hydrocyclone, an electrostatic coalescer, a centrifuge or a membrane filter press. In step (b) of the process according to the invention, the triglyceride oil phase $T_2$ is preferably separated off from the aqueous phase $W_2$ in a centrifuge.

If a salt should at least partially precipitate in $W_1$ during the contacting in step (a) and be present as a solid in the triglyceride oil phase $T_2$, it may also be removed by centrifugation or filtration. Solvent or water may also be added to the triglyceride oil phase $T_2$ containing the solid in order to bring the solid into solution, and to separate off the aqueous solution comprising the corresponding salt as described above.

In a preferred embodiment of the present invention, step (a) and step (b) of the process according to the invention, i.e. the contacting and separation, may be carried out in a centrifugal separator, such as is described for example in U.S. Pat. Nos. 4,959,158, 5,571,070, 5,591,340, 5,762,800, WO 99/12650 and WO 00/29120. In this case, $T_1$ and $W_1$ are firstly fed into the separator as separate streams and mixed in a circular mixing zone. The mixture is then conveyed to the separating zone where the phases are then separated with the aid of a centrifuge.

A series of centrifugal separators is preferably used, for example 2 to 6, 3 to 5 or 4, and the triglyceride oil $T_1$ is introduced into the first separator of the series, and the aqueous phase $W_1$ is introduced into the last separator of the series, such that triglyceride oil flows through from the first to the last separator of the series with decreasing content of fatty acids, while the aqueous phase flows through the separators in the opposite direction with increasing content of fatty acids. The aqueous phase $W_2$ is then withdrawn from the first separator of the series and the triglyceride oil phase $T_2$ is withdrawn from the last separator of the series.

In each case, the triglyceride oil phase $T_2$ may also be fed to a coalescing filter in order to remove last drops of aqueous solution from the fat or oil phase. A coalescing filter of this kind is known to those skilled in the art and comprises for example a filter material, which is wetted by the aqueous phase and by the oil phase, for example a filter material composed of glass or cellulose.

After separating off the triglyceride oil phase $T_2$ from the aqueous phase $W_2$ in step (b), the triglyceride oil phase $T_2$ may then be fed to a further workup or processing. A step of this kind may be one or more selected from degumming, deacidification, winterization, bleaching, depigmentation, deodorization. These steps are known to those skilled in the art and have been described in WO 2016/189114 A1 for example.

It will be apparent that the triglyceride oil phase $T_2$ after the separation in step (b) may be fed again once or more than once, for example twice up to ten times, to a contacting step (a), in which the triglyceride oil phase $T_2$ is used as triglyceride oil $T_1$ and in each step is contacted with a fresh charge of aqueous phase $W_1$ comprising alkali metal/alkaline earth metal (hydrogen)carbonate(s), in order to lower still further the fraction of fatty acids in the triglyceride oil phase $T_2$.

The aqueous phases $W_2$ obtained in these additional steps may then be be fed entirely or partially to the subsequent step (c) and so on.

Optionally, the following step (c) may then be carried out in which the aqueous phase is regenerated.

In this step (c), $CO_2$ and optionally an organic solvent is added to the aqueous phase $W_2$, whereby a fatty acid-containing organic phase, and an aqueous phase $W_3$ having a lower content of fatty acids compared to $W_2$, is obtained. The appropriate conditions are known to those skilled in the art and have been described in WO 2016/149692 A1 for example.

The contacting of the aqueous phase $W_2$ with $CO_2$ and optionally an organic solvent can be carried out by methods known to those skilled in the art. The contacting can be effected in a gas-tight sealable pressure vessel, in which $W_2$ and $CO_2$ and optionally an organic solvent may be mixed together. For this purpose, $CO_2$ may be introduced via a capillary or a gas-treatable stirrer. It will be apparent that the contacting is intended to be carried out such that as much $CO_2$ as possible is introduced into the aqueous phase $W_2$. For this purpose, for example, a mechanical mixer or an electromagnetic mixer is used.

If an organic solvent is added in step (c) of the process according to the invention, the ratio by volume of $W_2$ and the organic solvent in step (c) is not further restricted in this case. The ratio of the volume of $W_2$ to the volume of the organic solvent is then in particular in the range from 1:100 to 100:1, preferably from 1:5 to 5:1, even more preferably from 1:2 to 2:1.

If an organic solvent is used in step (c), preference is given to diisopropyl ether, n-butyl acetate, ethyl acetate, hexane, 1-hexanol, preferably n-butyl acetate.

The pressure and temperature in step (c) of the process according to the invention are not further restricted.

In particular, the pressure during the addition of $CO_2$ is in a range from 0.1 to 55 bar, preferably 1 to 20 bar, more preferably 5 to 10 bar.

The temperature is preferably in the range from 0° C. to 120° C., more preferably 5° C. to 100° C., yet more preferably 10° C. to 90° C., even more preferably 20° C. to 80° C., still more preferably 40° C. to 60° C., most preferably 50° C.

The $CO_2$ used in step (c) may originate from a combustion process or blast furnace process and may comprise other constituents such as $N_2O$, $SO_2$, $H_2S$, $NO_2$. These constituents may further acidify the aqueous phase $W_2$ which further promotes the formation of a fatty acid-containing organic phase.

At the end of step (c), a fatty acid-containing organic phase and an aqueous phase $W_3$, which has a lower content of fatty acids compared to $W_2$, are obtained.

In the further optional step (d) in the process according to the invention, the aqueous phase $W_3$ may be separated off from the fatty acid-containing organic phase obtained in step (c).

This may be carried out by processes familiar to those skilled in the art, as also described for step (b) of the process according to the invention.

After completion of step (d), a phase $W_3$ is obtained which may be added to a new cycle with a fresh batch of triglyceride oil.

Therefore, in an optional further step (e), at least part of the aqueous phase $W_3$ is contacted with further triglyceride oil $T_3$ comprising at least one quaternary ammonium salt and at least one aliphatic diol having 1 to 8 carbon atoms, whereby a triglyceride oil phase $T_4$ and an aqueous phase $W_4$ are obtained, wherein $T_4$ has a reduced content of fatty acids compared to $T_3$ and $W_4$ has an increased content of fatty acids compared to $W_3$.

This further step (e) is preferably carried out as described for step (a). The process according to the invention is especially suitable for always recycling the aqueous phase $W_1$ and for its use in a new extraction run.

I will be apparent that the triglyceride phase $T_2$ obtained in step (b) of the process according to the invention may be subjected to one or more further refining steps which is/are selected, for example, from degumming, deacidification, bleaching, depigmentation, deodorizing, winterization.

The examples which follow are intended to elucidate the invention, but without restricting it thereto.

EXAMPLES

Measurement Methods Used:

The choline content in the triglyceride phase was determined by HPLC-ESI-MS on an Infinity II with QQQ-6430 from Agilent. For this purpose, ca. 50 mg of sample were diluted in 10 mL of water acetone 1:1 (v:v) and analyzed by the HILIC separation method, ESI pos. detection. The results were evaluated via two calibration functions. The correlation coefficient was determined where $R_2$=0.9997/0.9999.

Comparative Example C1

To 30 g of palm oil (5.5% free fatty acids, determined by titration by DGF method DGF-C-V 2) were added 70 g of an aqueous choline hydrogen carbonate solution (75.0% by weight, density ca. 1.16 g/mL; ~5.3 mol/L) and the mixture was stirred at 80° C. for 1 hour. After reaction was complete, the aqueous phase and the organic phase were separated in a separating funnel. The content of fatty acids in the triglyceride phase obtained was determined by titration as 0.11% by weight. This corresponds to a reaction of free fatty acids of 98.2%. The choline content in the triglyceride phase was determined by HPLC-ESI-MS as 113 646 ppm.

Comparative Example C2

To 30 g of palm oil (5.5% free fatty acids, determined by titration by DGF method DGF-C-V 2) were added 70 g of an aqueous choline hydrogen carbonate solution (80.0% by weight, density ca. 1.17 g/mL; ~5.7 mol/L) and the mixture was stirred at 80° C. for 1 hour. After reaction was complete, the aqueous phase and the organic phase were separated in a separating funnel. The content of fatty acids in the triglyceride phase obtained was determined by titration as 0.08% by weight. This corresponds to a reaction of free fatty acids of 98.6%. The free choline content in the triglyceride phase was determined by HPLC-ESI-MS as 6405 ppm.

Inventive Example E1

To 30 g of palm oil (5.5% free fatty acids, determined by titration by DGF method DGF-C-V 2) were added 66.5 g of an aqueous choline hydrogen carbonate solution (75.0% by weight, density ca. 1.16 g/mL; molar concentration of choline hydrogen carbonate ~5.3 mol/L; corresponds to 0.30 mol of choline hydrogen carbonate) and 3.5 g (56.4 mmol) of ethylene glycol and the mixture was stirred at 80° C. for 1 hour. After reaction was complete, the aqueous phase and the organic phase were separated in a separating funnel. The content of fatty acids in the triglyceride phase obtained was determined by titration as 0.16% by weight. This corresponds to a reaction of free fatty acids of 97.2%. The free choline content in the triglyceride phase was determined by HPLC-ESI-MS as 389 ppm. The triglyceride phase obtained was subsequently treated with 1.5 g (0.5% by weight based on the triglyceride phase) of Tonsil Supreme 118 F bleaching earth and wet-bleached at 95° C. for 5 minutes and dry-bleached for 15 minutes under vacuum. After filtration of the bleaching earth, the triglyceride phase was decolorized at 240° C. for 10 min under vacuum and steamed at 200° C. with dist. water for a further 90 minutes The oil obtained was virtually colourless and had a neutral taste and odour.

Inventive Example E2

To 30 g of palm oil (5.5% free fatty acids, determined by titration by DGF method DGF-C-V 2) were added 66.5 g of an aqueous choline hydrogen carbonate solution (80.0% by weight, density ca. 1.17 g/mL; molar concentration of choline hydrogen carbonate ~5.7 mol/L; corresponds to 0.32 mol of choline hydrogen carbonate) and 3.5 g (56.4 mmol) of ethylene glycol and the mixture was stirred at 80° C. for 1 hour. After reaction was complete, the aqueous phase and the organic phase were separated in a separating funnel. The content of fatty acids in the triglyceride phase obtained was determined by titration as 0.13% by weight. This corresponds to a reaction of free fatty acids of 97.8%. The free choline content in the triglyceride phase was determined by HPLC-ESI-MS as 2442 ppm.

Inventive Example E3

To 30 g of palm oil (5.5% free fatty acids, determined by titration by DGF method DGF-C-V 2) were added 66.5 g of an aqueous choline hydrogen carbonate solution (75.0% by weight, density ca. 1.16 g/mL; molar concentration of choline hydrogen carbonate ~5.3 mol/L; corresponds to 0.30 mol of choline hydrogen carbonate) and 3.5 g (46.0 mmol) of 1,2-propanediol and the mixture was stirred at 80° C. for 1 hour. After reaction was complete, the aqueous phase and the organic phase were separated in a separating funnel. The content of fatty acids in the triglyceride phase obtained was determined by titration as 0.11% by weight. This corresponds to a reaction of free fatty acids of 98.2%. The free choline content in the triglyceride phase was determined by HPLC-ESI-MS as 4853 ppm.

Inventive Example E4

To 30 g of palm oil (5.5% free fatty acids, determined by titration by DGF method DGF-C-V 2) were added 66.5 g of an aqueous choline hydrogen carbonate solution (75.0% by weight, density ca. 1.16 g/mL; molar concentration of choline hydrogen carbonate ~5.3 mol/L; corresponds to 0.30 mol of choline hydrogen carbonate) and 3.5 g (29.6 mmol) of 1,6-hexanediol and the mixture was stirred at 80° C. for 1 hour. After reaction was complete, the aqueous phase and the organic phase were separated in a separating funnel. The content of fatty acids in the triglyceride phase obtained was determined by titration as 0.13% by weight. This corresponds to a reaction of free fatty acids of 97.8%. The free choline content in the triglyceride phase was determined by HPLC-ESI-MS as 8924 ppm.

The results of the experiments are summarized in Table 1 below.

TABLE 1

| Example | Diol | FFA content [%] | Conversion [%] | Choline content [ppm] | Separation time |
|---|---|---|---|---|---|
| C1 | — | 0.11 | 98.2 | 11364 | 120 min, cloudy aqueous phase |
| C2 | — | 0.08 | 98.6 | 6405 | 30 min, cloudy aqueous phase |
| C3 | 3.5 g glycerol | 0.11 | 98.2 | 6855 | 120 min, cloudy aqueous phase |
| E1 | 3.5 g ethylene glycol | 0.16 | 97.2 | 389 | 30 min, clear phases |
| E2 | 3.5 g ethylene glycol | 0.13 | 97.8 | 2442 | 45 min, clear phases |
| E3 | 3.5 g 1,2-propanediol | 0.11 | 98.2 | 4853 | 45 min, clear phases |
| E4 | 3.5 g 1,6-hexanediol | 0.13 | 97.8 | 8924 | 45 min, clear phases |

Accordingly, it has been shown that, surprisingly, a clear phase could only be obtained when using the diol. In addition, the undesired residue of free choline in the resulting extracted oil was significantly reduced only upon combination with an aliphatic diol such as ethylene glycol or 1,2-propanediol.

The invention claimed is:

1. A process for extracting a fatty acid from a triglyceride oil, the process comprising:

(a) contacting a triglyceride oil $T_1$ comprising the fatty acid with an aqueous solution $W_1$ comprising at least one quaternary ammonium salt and at least one aliphatic diol having 1 to 8 carbon atoms, whereby a triglyceride oil phase $T_2$ and an aqueous phase $W_2$ are obtained, wherein $T_2$ has a reduced content of fatty acid compared to $T_1$ and $W_2$ has an increased content of fatty acid compared to $W_1$; and (b) separating the triglyceride oil phase $T_2$ from the aqueous phase $W_2$;

wherein the quaternary ammonium salt comprises at least one quaternary ammonium cation and at least one basic anion selected from the group consisting of hydroxide, alkoxide, alkyl carbonate, hydrogen carbonate, carbonate, serinate, prolinate, histidinate, threoninate, valinate, aspartate, taurinate, and lysinate wherein said quaternary ammonium cation is at least one cation according to the structure $$[N(R^a)(R^b)(R^c)(R^d)]^+,$$

wherein $R^a$, $R^b$, $R^c$ and $R^d$ are each independently a $C_1$ to $C_8$ alkyl, and wherein one or more of the radicals $R^a$, $R^b$, $R^c$ and $R^d$ is optionally substituted on one carbon atom by a group selected from the group consisting of: $C_1$ to $C_4$ alkoxy, $C_2$ to $C_8$ alkoxyalkoxy, $C_3$ to $C_6$ cycloalkyl, —OH, —SH, —$CO_2R^e$, and —OC(O)$R^e$, wherein $R^e$=$C_1$ to $C_6$ alkyl.

2. The process according to claim 1, wherein the quaternary ammonium cation is choline.

3. The process according to claim 1, wherein the basic anion is at least one member selected from the group consisting of alkyl carbonate, hydrogen carbonate, carbonate, hydroxide, and alkoxide.

4. The process according to claim 3, wherein the basic anion is hydrogen carbonate.

5. The process according to claim 1, wherein the aliphatic diol comprises 1 to 4 carbon atoms.

6. The process according to claim 5, wherein the aliphatic diol is at least one member selected from the group consisting of ethylene glycol and propanediols.

7. The process according to claim 1, wherein said a) contacting is conducted at a temperature of 70° C. to 90° C.

8. The process according to claim 1, wherein a ratio of the volume of the triglyceride oil $T_1$ to the volume of the aqueous solution $W_1$ is in the range from 10:1 to 1:100.

9. The process according to claim 1, wherein, in the aqueous solution $W_1$ in said a) contacting, a proportion of aliphatic diol relative to quaternary ammonium salt is such that the molar amount of all aliphatic diols having 1 to 8 carbon atoms, based on the molar amount of all quaternary ammonium salts, and wherein the quaternary ammonium salt comprises at least one quaternary ammonium cation and at least one basic anion selected from the group consisting of hydroxide, alkoxide, alkyl carbonate, hydrogen carbonate, carbonate, serinate, prolinate, histidinate, threoninate, valinate, aspartate, taurinate, and lysinate, is in the range from 0.0001% to 99.9%.

10. The process according to claim 1, wherein, a total concentration of said at least one quaternary ammonium salt in said aqueous solution is 70 to 80% by weight.

11. The process according to claim 1, wherein, a proportion of aliphatic diol relative to quaternary ammonium salt is 0.0001 to 99.9%.

12. The process according to claim 1, wherein, a proportion of aliphatic diol relative to quaternary ammonium salt is 0.01 to 50.0%.

13. The process according to claim 1, wherein, a proportion of aliphatic diol relative to quaternary ammonium salt is 0.1 to 40.0%.

14. The process according to claim 1, wherein, a proportion of aliphatic diol relative to quaternary ammonium salt is 1.0 to 30.0%.

15. The process according to claim 1, further comprising (c) adding $CO_2$ and optionally an organic solvent to said aqueous phase $W_2$, whereby an aqueous phase $W_3$ having a lower content of fatty acids compared to $W_2$ and a fatty acid-containing organic phase are obtained.

16. The process according to claim 1, wherein a molar ratio of all quaternary ammonium salts contained in said aqueous phase $W_1$ to all fatty acids contained in said triglyceride oil $T_1$ is 1:1 to 500:1.

17. The process according to claim 15, wherein a pressure of $CO_2$ during said adding is from 0.11 to 55 bar.

18. The process according to claim 1, wherein said triglyceride oil further comprises at least one glyceride selected from the group consisting of a monoglyceride and a diglyceride.

19. The process according to claim 1, wherein said triglyceride oil is at least one oil selected from the group consisting of coconut oil, corn oil, cottonseed oil, olive oil, palm oil, peanut oil, rice bran oil, soybean oil, sunflower oil, rapeseed oil, castor oil and safflower oil.

* * * * *